US010399358B2

(12) United States Patent
Lichtenberg

(10) Patent No.: US 10,399,358 B2
(45) Date of Patent: Sep. 3, 2019

(54) METHOD AND APPARATUS FOR PROTECTING A PRINT HEAD IN A THERMAL PRINTER

(71) Applicant: Hurst International, Chatsworth, CA (US)

(72) Inventor: Ari Lichtenberg, Chatsworth, CA (US)

(73) Assignee: HURST INTERNATIONAL, Chatsworth, CA (US)

( * ) Notice: Subject to any disclaimer, the term of this patent is extended or adjusted under 35 U.S.C. 154(b) by 18 days.

(21) Appl. No.: 15/839,267

(22) Filed: Dec. 12, 2017

(65) Prior Publication Data

US 2019/0176480 A1 Jun. 13, 2019

(51) Int. Cl.
*B41J 2/335* (2006.01)

(52) U.S. Cl.
CPC ..... *B41J 2/3353* (2013.01); *B41J 2202/30* (2013.01)

(58) Field of Classification Search
None
See application file for complete search history.

(56) References Cited

U.S. PATENT DOCUMENTS 6,317,150 B1 * 11/2001 Ono ..... B41J 2/345 347/200
2003/0142176 A1 * 7/2003 Wu ..... B41J 2/175 347/85
2011/0193927 A1 * 8/2011 Matsushima ..... B41J 2/32 347/218
2014/0232055 A1 * 8/2014 Yamagata ..... B65H 7/02 271/3.18

* cited by examiner

*Primary Examiner* — Matthew Luu
*Assistant Examiner* — Tracey M McMillion
(74) *Attorney, Agent, or Firm* — Tutunjian & Bitetto, P.C.

(57) ABSTRACT

The method and apparatus for protecting the printhead in a thermal printer includes preparing the printer for label dispensing and then covering the printhead such that the label run or thermal material passing over the same does not contact the printhead. The cover for the printhead can take various forms. In one implementation, the cover is a sleeve configured to fit over the entire printhead assembly of the thermal printer. The printhead cover has a low coefficient of friction.

8 Claims, 3 Drawing Sheets

METHOD AND APPARATUS FOR PROTECTING A PRINT HEAD IN A THERMAL PRINTER

BACKGROUND

Technical Field

The present invention relates to thermal printers. More particularly, it relates to a method and device for protecting the print head of a thermal printer.

Description of the Prior Art

Thermal printers are used for many different label printing operations. They are also used in some industries as label dispensers as well as printers. The direct thermal print heads in these printers are subject to wear when printing labels, and also when not printing labels (i.e., when the printer is being used as a label dispenser for already printed labels) and the thermal printer portion is turned off. In either instance, the abrasive action or friction of the labels or other material traveling against the surface of the direct thermal print head surface will cause damage to the print head. In fact, this abrasive action/friction is the main cause of damage to the thermal print head. Thus, when using the thermal printer as a label dispenser for already printed labels, there is a need to protect the print head from this abrasive action.

SUMMARY OF THE INVENTION

The present inventions addresses the shortfalls of existing thermal printing machines by providing a protective cover to the direct thermal print head to prevent head wear when the printer is being used to dispense already printed labels.

According to one implementation, the thermal printer includes a print head assembly having a printhead, and a cover removably disposed over the printhead and configured to prevent the same from being exposed to a thermal material passing over the same during label dispensing.

According to a further implementation, the printhead cover has a low coefficient of friction and is in the form of a sleeve that fits over the entire printhead assembly.

Other aspects and features of the present principles will become apparent from the following detailed description considered in conjunction with the accompanying drawings. It is to be understood, however, that the drawings are designed solely for purposes of illustration and not as a definition of the limits of the present principles, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION

Figure 1:
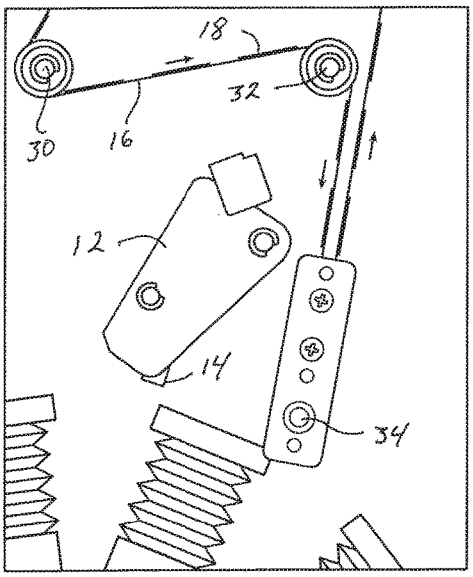
FIG. 1 is a schematic overview of the print head of a thermal printer and label path with the print head positioned away from the label run, according to an embodiment of the invention.
Figure 2:
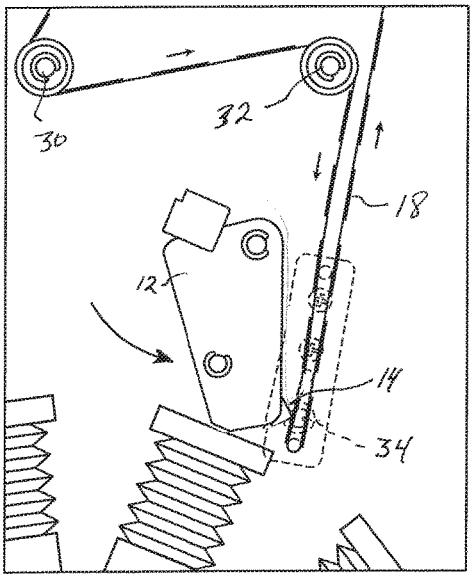
FIG. 2 is a schematic overview of the print head of a thermal printer and label path with the print head positioned against the label run during dispensing, according to an embodiment of the invention.

FIGS. 1 and 2 schematically show the print head assembly 12 having the print head 14 within a thermal printer. The label run 16 includes a plurality of labels 18 spaced thereon. The label run passes around various directional spindles 30, 32, 34, etc. to be guided through the printer across the print head 14 when the print head assembly is engaged (FIG. 2). As shown, as the labels 18 pass across the printhead 14 during printing or dispensing. As such, the abrasive action or the friction of the labels 18 passing over the printhead 14 results in damage and wear to the same. Thus, when using the thermal printer for label dispensing and not printing, it will become apparent that such action of running the labels through the printer and across the printhead 14 will ultimately result in increased wear of the printhead, and ultimately shorten the usable life of the same.

Figure 3:
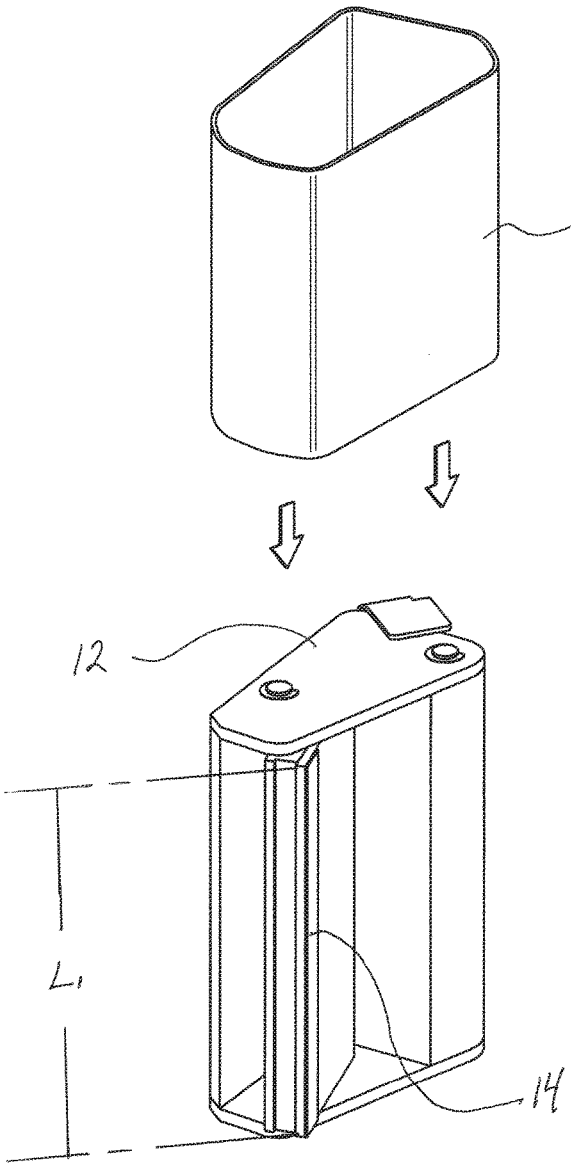
FIG. 3 is an exploded view of the print head with protective sleeve, according to an embodiment of the invention.
Figure 4:
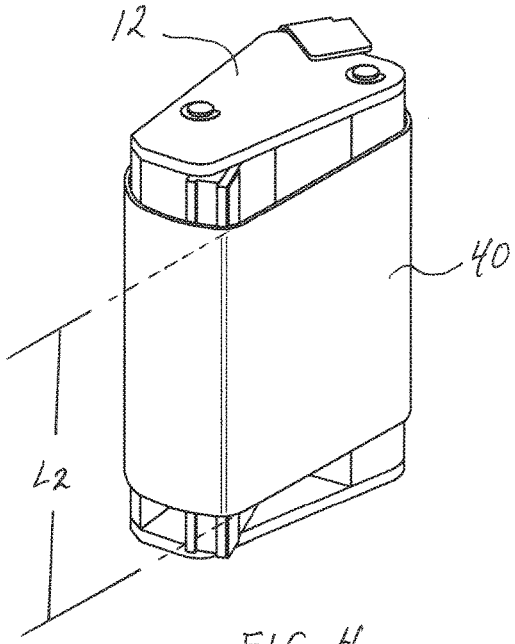
FIG. 4 is a plan view of the print head with the protective sleeve in place, according to an embodiment of the invention.

FIG. 3 shows the printhead assembly 12 (removed from the printer for ease of description) and a protective sleeve 40 according to an embodiment of the present invention. As shown in FIG. 4, the sleeve 40 fits over the printhead assembly 12 as shown. Generally speaking the printhead 14 will have a length or size $L_1$ which essentially dictates the size of the printing area of the same.

Figure 5:
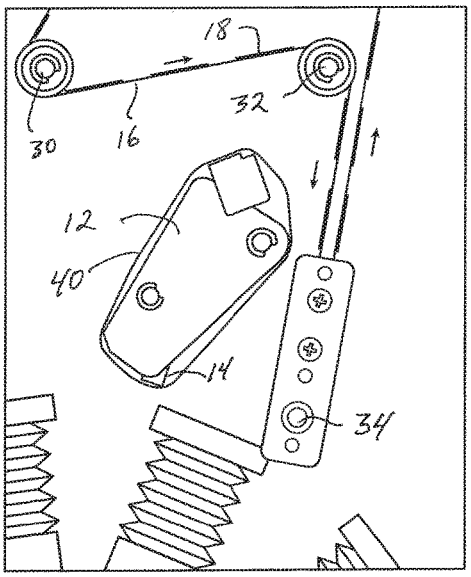
FIG. 5 is a schematic overview of the print head of a thermal printer with the protective sleeve in place while the print head is positioned away from the label run, according to an embodiment of the invention.
Figure 6:
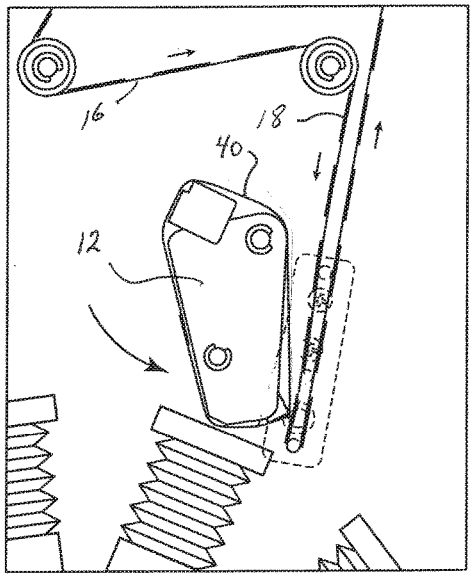
FIG. 6 is a schematic overview of the print head of a thermal printer with the protective sleeve in place and label path with the protected print head positioned against the label run during dispensing, according to an embodiment of the invention.

FIG. 5 shows the printhead assembly 12 with the protective sleeve 40 positioned thereon and before the printhead assembly 12 is engaged for label printing or dispensing. FIG. 6 shows the printhead assembly 12 with the protective sleeve 40 engaged for label printing or dispensing. As shown, now, as the labels 18 move through the printer, the printhead 14 is protected from the abrasive action caused by the labels moving across the same. When dispensing is completed, the protective sleeve 40 can be removed and the printer used for printing as usual.

In accordance with one embodiment, the coefficient of friction of the protective sleeve is very low. Those of skill in the art will appreciate that the coefficient of friction for different materials can be drastically different. As such, and as a guideline, the coefficient of friction for most materials is between 0 and 1, with 0 being the lowest (i.e., no friction). According to the present principles, the printhead cover or sleeve has a low coefficient of friction, preferably 0.3 or less.

In accordance with one exemplary embodiment, the protective sleeve 40 is made of an ultra high molecular weight flexible tape (UHMW) having a coefficient of friction in a range of 0.10-020, and has a length or size $L_2$ that does not necessarily have to equal the length or size $L_1$ of the printhead 14. In fact, the length or size $L_2$ can be dictated by the size or width of the label run (thermal material) 16 that would be passing over the printhead 14. Thus, L2 will generally be less than L1 in this instance, but L2 must always be larger than the width of the label run or thermal material 16.

In accordance with other contemplated embodiments, the protective sleeve 40 can be replaced with other devices that operate in the same manner to shield the printhead 14 from the abrasive action caused by the labels moving across the same.

Examples of such other embodiments include a clip on cover that clips onto the printhead 14 or the assembly 12. In this embodiment, it is envisioned that the clips would engage another portion of the printhead assembly 12 such that a thin strip of material covers the printhead 14. Another embodiment would include a strip having a removable adhesive that covers the print elements of the print head 14. This strip could be disposable and be a single use type of product. According to yet another embodiment, the printer could be modified to allow the roller assembly 34 which applies pressure on the back of the thermal material (i.e., label run 16) to be retracted away from the printhead 14 such that the thermal material 16 does not come into contact with the same when operating the printer as a label dispenser.

Figure 7:
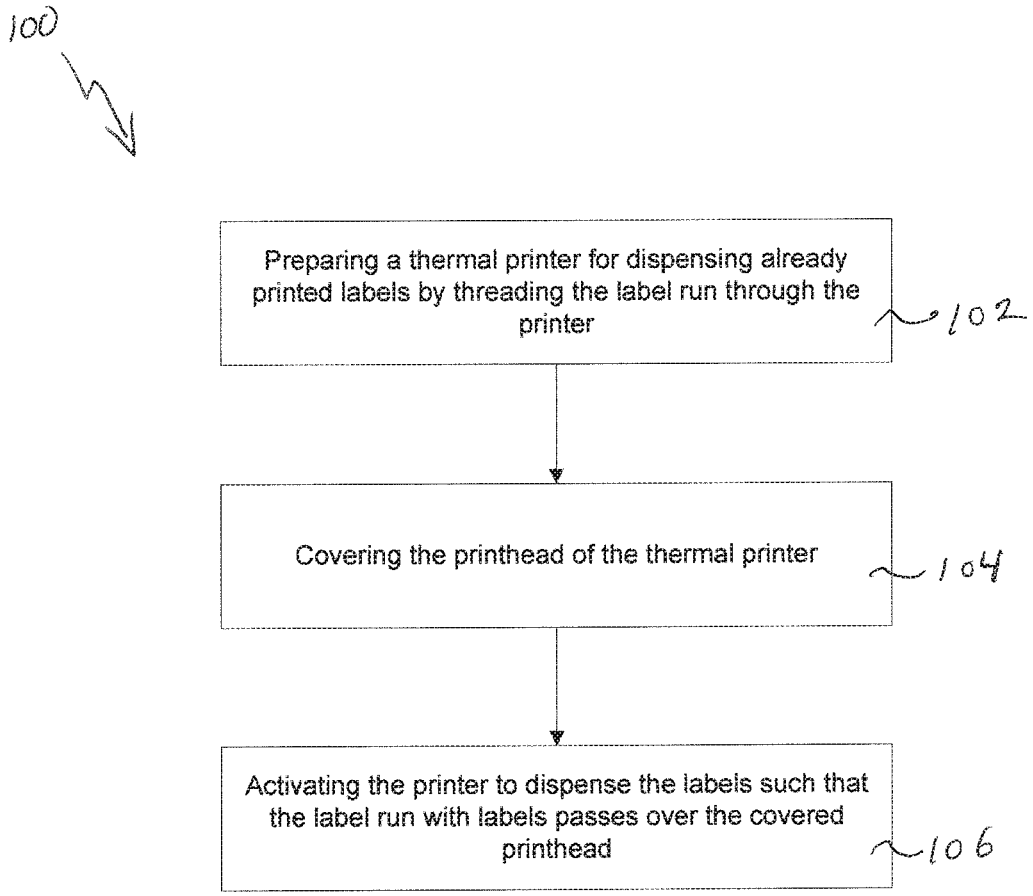
FIG. 7 is a flow chart of the method for protecting/covering the printhead in a thermal printer, according to an embodiment of the invention.

In accordance with other embodiment shown in FIG. 7, a method 100 for protecting the printhead of a thermal printer is provided. The method includes preparing the thermal printer for dispensing already printed labels (thermal material)—102. Once prepared, the printhead is covered with a thin material having a low coefficient of friction—104. Once covered, the printer is engaged or activated to dispense the labels—106, and the thermal material or label run is run through the printer and over the covered printhead such that the printehad is no longer exposed to the abrasive action causes by the thermal material passing over the same.

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or implementation of the present principles may be incorporated in any other disclosed, described or suggested form or implementation as a general matter of design choice. It is the intention, therefore, to be limited only as indicated by the scope of the claims appended hereto.

What is claimed is:

1. A method for operating a thermal printer comprising:

preparing the printer for dispensing already printed labels by threading a label run or thermal material through the printer in a manner appropriate for printing the labels;

covering print elements of a printhead of the thermal printer; and activating the printer to dispense the labels, said activating causing the label run with labels to pass over the covered print elements without exposing the labels to the print elements.

2. The method of claim 1, further comprising uncovering the print elements upon completing dispensing the already printed labels.

3. The method of claim 1, wherein covering print elements includes positioning a protective covering on the printhead to cover the print elements.

4. The method of claim 3, wherein the protective covering has a low coefficient of friction.

5. The method of claim 4, wherein the coefficient of friction is 0.3 or less.

6. The method of claim 3, wherein the protective covering includes an ultra high molecular weight flexible tape.

7. The method of claim 1, wherein covering print elements includes attaching a clip-on cover onto the printhead such that a portion of the clip-on cover covers a portion of the print elements aligned with the print labels.

8. The method of claim 1, wherein covering print elements includes removably adhering a strip of material over the print elements.

* * * * *